United States Patent [19]

Belanger et al.

[11] Patent Number: 5,029,842

[45] Date of Patent: Jul. 9, 1991

[54] SIGNATURE HANDLING APPARATUS

[75] Inventors: Roger R. Belanger, Dover; Eugene J. Bergeron, Rochester; Roland T. Palmatier, Durham, all of N.H.

[73] Assignee: Harris Graphics Corporation, Dover, N.H.

[21] Appl. No.: 547,318

[22] Filed: Jul. 2, 1990

Related U.S. Application Data

[63] Continuation of Ser. No. 289,189, Dec. 23, 1988, abandoned.

[51] Int. Cl.[5] ..... B26H 29/70

[52] U.S. Cl. ..... 271/188; 271/209; 83/105; 83/155; 83/161; 29/120; 29/132

[58] Field of Search ..... 83/105, 107, 161, 155.1, 83/155; 271/188, 209; 493/463, 464, 407, 403, 381, 355, 346; 29/120, 132; 101/422

[56] References Cited

U.S. PATENT DOCUMENTS

| | | | |
|---|---|---|---|
| 1,231,141 | 6/1917 | Ellis | 101/422 |
| 2,501,835 | 3/1950 | Barber | 83/155 X |
| 4,312,444 | 1/1982 | Mushovic | 29/132 X |
| 4,373,713 | 2/1983 | Loebach | 83/105 X |
| 4,402,267 | 9/1983 | DeMoore | 101/422 X |
| 4,522,387 | 6/1985 | Leuthold | 271/209 X |
| 4,589,650 | 5/1986 | Miyoshi | 271/188 X |
| 4,744,555 | 5/1988 | Naramore et al. | 271/188 X |
| 4,769,969 | 9/1988 | Minami | 493/381 X |
| 4,811,641 | 3/1989 | Müller | 83/161 X |

FOREIGN PATENT DOCUMENTS

| | | | |
|---|---|---|---|
| 0249874 | 12/1987 | European Pat. Off. | 271/209 |
| 2017622 | 10/1979 | United Kingdom | 271/209 |

*Primary Examiner*—Frank T. Yost
*Assistant Examiner*—Rinaldi Rada
*Attorney, Agent, or Firm*—Tarolli, Sundheim & Covell

[57] ABSTRACT

A signature handling apparatus includes a first conveyor which sequentially moves signatures to a discharge station. At the discharge station, the signatures are sequentially transferred to a receiving conveyor. A corrugator assembly is located at the discharge station to stiffen the signatures by forming corrugations which extend between leading and trailing end portions of the signatures. Although the corrugations are only temporarily maintained in the signature, the corrugator assembly is close enough to the receiving conveyor so that a corrugation is maintained in a signature as a leading end portion of the signature moves to the receiving conveyor. Thus, the corrugator assembly is spaced from the receiving conveyor by a distance which is less than the distance between the leading and trailing end portions of the signatures.

21 Claims, 4 Drawing Sheets

SIGNATURE HANDLING APPARATUS

This is a continuation of co-pending application Ser. No. 07/289,189 filed on 12/23/88 now abandoned.

BACKGROUND OF THE INVENTION

The present invention relates to a signature handling apparatus in which signatures (or sheets) are sequentially transferred from one conveyor to another conveyor.

A known signature handling apparatus includes a tape (or belt) conveyor which sequentially moves signatures to a discharge station. At the discharge station, the signatures are transferred to pockets of a fan wheel. The fan wheel conveyor then conveys the signatures to a belt (or tape) type delivery conveyor.

The speed of operation of this known signature handling apparatus is limited by the ability of signatures to be transferred from the tape conveyor to the pockets of the fan wheel conveyor. This is because the signatures are formed of one or more flexible sheets of material which tend to deflect due to air resistance or turbulence and allow the signatures to open and/or move in a direction other than the desired direction as they are transferred from the tape conveyor to the fan wheel. This uncontrolled transfer of signatures through mid-air between the tape conveyor and the fan wheel limits the speed of movement of the signatures, in at least one known signature handling apparatus, to approximately 1,200 feet per minute.

BRIEF DESCRIPTION OF THE INVENTION

The present invention provides a new and improved signature handling apparatus in which a first conveyor has a discharge station at which signatures are transferred to a second conveyor. In order to increase the speed at which the signatures can move between conveyors, one or more corrugations are formed in the signatures to stiffen the signatures. Thus, a corrugator assembly is located at the discharge station of the first conveyor and sequentially forms corrugations extending between leading and trailing end portions of the signatures to stiffen the signatures.

Since it is desired to have the signatures free of corrugations after the transfer has been made from the first conveyor to the second conveyor, the corrugator assembly resiliently deforms the signatures to form temporary corrugations which disappear after the signatures have moved out of the corrugator assembly. To have the corrugations maintained in the signatures during their high speed movement between conveyors, the corrugator assembly is spaced from the second conveyor by a distance which is less than the distance between leading and trailing end portions of the signatures. Therefore, during movement of a leading portion of a signature through the space between the two conveyors and during initial engagement of the signature with the second conveyor, a trailing portion of the signature is disposed in the corrugator assembly.

Accordingly, it is an object of this invention to provide a new and improved signature handling apparatus in which signatures are transferred from a first conveyor to a second conveyor and wherein a corrugator assembly in the first conveyor is spaced from the second conveyor by a distance which is less than the distance between leading and trailing end portions of a signature to enable the leading end portion of a signature to move to the second conveyor while the signature is engaged by the corrugator assembly.

BRIEF DESCRIPTION OF THE DRAWINGS

The foregoing and other objects and features of the present invention will become more apparent upon a consideration of the following description taken in connection with the accompanying drawings, wherein.

DESCRIPTION OF A SPECIFIC PREFERRED EMBODIMENT OF THE INVENTION

Folder Assembly

Figure 1:
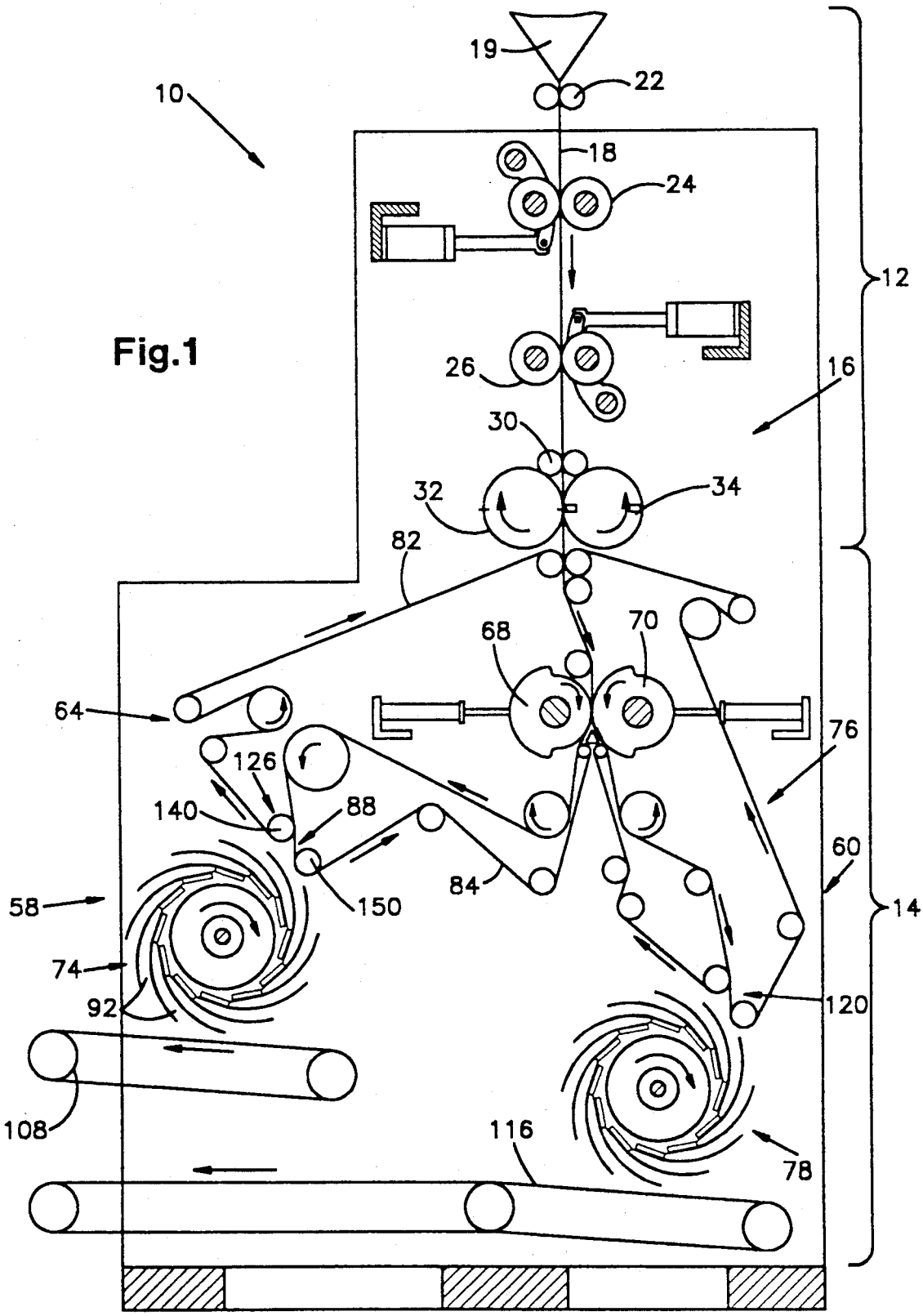
FIG. 1 is a schematic illustration of a folder assembly having a signature handling apparatus in which signatures are transferred from a tape conveyor to a fan wheel.

A diverter folder assembly 10 (FIG. 1) includes a signature forming section 12 and a signature handling section 14. Signature forming apparatus 16 in the signature forming section 12 is operable to crease and cut a longitudinally extending sheet material web 18. The signature forming apparatus 16 includes forming rolls 22 which cooperate with a formerboard 19 to form a longitudinally extending crease in the web 18 in a known manner. Nipping rolls 24 and 26 press against the web to further form the longitudinally extending crease in the web.

Figure 4:
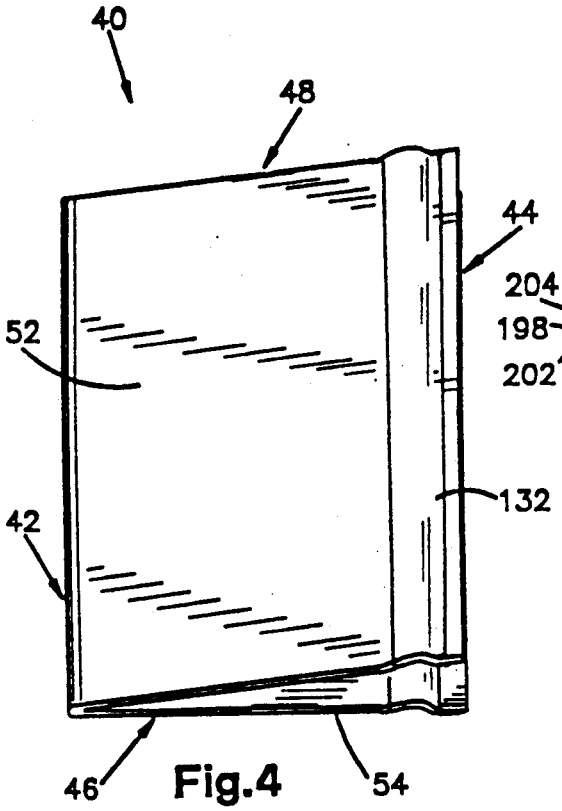
FIG. 4 is an illustration depicting a signature having a corrugation formed therein.

The creased web is moved through lead-in rollers 30 to cutting cylinders 32 and 34. During each revolution of the cutting cylinders 32 and 34, blades cut or sever the web in a direction extending perpendicular to the crease to form signatures 40 (FIG. 4) in a known manner.

Each of the signatures 40 has a closed or creased edge portion 42 (FIG. 4) which is disposed opposite from an open edge portion 44. The signature has an end portion 46 which is leading as the signature moves out of the cutting cylinders 32 and 34 and an end portion 48 which is trailing as the signature moves out of the cutting cylinders. Opposite major outer side surfaces 52 and 54 of the signature 40 are flat when the signature leaves the cutting cylinders 32 and 34.

The signature handling apparatus 14 includes two delivery sections, that is, a left (as viewed in FIG. 1) delivery section 58 and a right (as viewed in FIG. 1) delivery section 60. The left delivery section 58 includes a first or tape conveyor 64 which accelerates the signatures 40 received from the signature forming apparatus 12 to separate their leading and trailing end portions. Diverter rolls 68 and 70 direct every other signature to the left delivery section 58 and a second conveyor or fan wheel 74.

In the right delivery section 60 (FIG. 1), a first or tape conveyor 76 cooperates with the tape conveyor 64 to sequentially accelerate the signatures 40 received from the cutting cylinders 32 and 34. The diverter rolls 68 and 70 enable the first or tape conveyor 76 to sequentially convey every other signature to a second conveyor or fan wheel 78.

During operation of the folder assembly 10, the diverter rolls 68 and 70 receive a steady stream of signatures from the cutting cylinders 32 and 34. The signatures are accelerated by cooperation between the tape conveyors 64 and 76 to slightly separate the signatures before they enter the nip between the diverter rolls 68 and 70. The diverter rolls 68 and 70 are rotated in timed relationship with the cutter cylinders 32 and 34 and alternately direct signatures to the left and right delivery sections 58 and 60. Thus, if one signature is directed to the left delivery section 58 by the diverter rolls 68 and 70, the next succeeding signature is directed to the right delivery section 60 by the diverter rolls.

When the diverter rolls 68 and 70 are in the position shown in FIG. 1, they are effective to divert a signature to the left delivery section 58. When the diverter rolls 68 and 70 have been rotated through 180 degrees from the position shown in FIG. 1, the diverter rolls are effective to direct a signature to the right delivery section 60. The manner in which the diverter rolls 68 and 70 cooperate to sequentially direct signatures to the left and right delivery sections 58 and 60 is known and will not be further described herein to avoid prolixity of description.

The first or tape conveyor 64 in the left delivery section 58 includes a plurality of spaced apart relatively narrow upper tapes 82 which engage the major side surface 54 of a signature 40. Similarly, a plurality of relatively narrow and spaced apart lower tapes 84 engage the opposite major side surface 52 of the signature 40. The signature 40 is firmly held between the tapes 82 nd 84 and moved at a relatively high speed in a controlled manner by the tapes.

It should be understood that although only a single tape 82 has been shown in FIG. 1, there are a plurality of spaced apart tapes 82, specifically six tapes (see FIG. 3), which engage the major side surface 54 of a signature. Similarly, although only a single tape 84 has been shown in FIG. 1, it should be understood that there are six spaced apart tapes 84 (FIG. 3) which engage the major side surface 52 of a signature 40 at locations opposite to the locations where the tapes 82 engage the signatures. The tapes 82 and 84 extend around guide rolls and grip opposite sides of a signature 40 to convey the signature in a known manner without slippage between the tapes and the signature.

In the illustrated embodiment of the invention, the second conveyor 74 is a circular fan wheel. The fan wheel 74 receives signatures from the tape conveyor 64. Thus, the tape conveyor 64 has a discharge station 88 (FIG. 2) where signatures move from the first or tape conveyor 64 to the second conveyor or fan wheel 74. If desired, other known types of conveyors could be substituted for the tape conveyor 64 and/or fan wheel 74.

The fan wheel 74 includes a circular array of pockets 92 (FIG. 2) which extend radially outwardly from a hub 94. The pockets 92 are formed by adjacent blades or fan elements 96. The fan elements 96 cooperate to define open outer end portions 100 of the pockets 92. The open outer end portions 100 of the pockets 92 move along a circular path, indicated by a dashed line 104 in FIG. 2. The axis of rotation of the fan wheel 74 extends perpendicular to longitudinal axes of the tapes 82 and 84.

Figure 2:
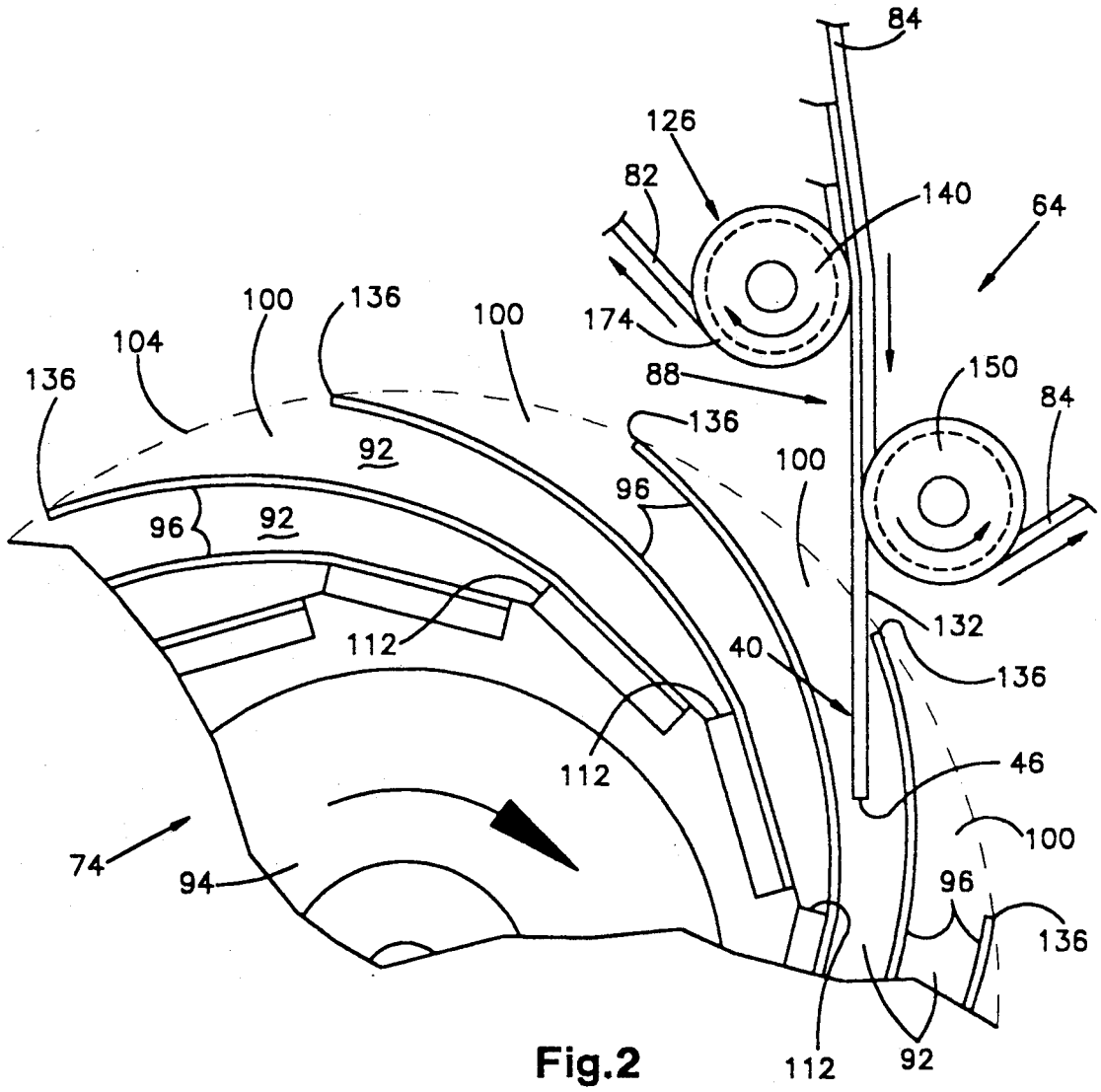
FIG. 2 is an enlarged fragmentary schematic illustration of the relationship between a corrugator assembly at a discharge station of the tape conveyor and the fan wheel as a signature moves into the fan wheel.

When an open end portion 100 of a pocket 92 faces upwardly and is adjacent to the discharge station 88, a signature 40 moves into the pocket, in the manner shown schematically in FIG. 2. After the fan wheel 74 has rotated through approximately 180 degrees, the signature moves out of the pocket, under the influence of gravity or a mechanical stripping arm, onto a third or delivery belt conveyor 108 (FIG. 1).

When a signature 40 moves into a pocket 92, in the manner indicated schematically in FIG. 2, the leading end portion 46 of the signature moves through the open outer end 100 of the pocket. As the fan wheel 74 continues to rotate, in a clockwise direction as viewed in FIG. 2, the tape conveyor 64 moves the signature 40 downwardly in the pocket 92. Thus, the tape conveyor 64 moves the signature 40 downwardly into a pocket 92 at a speed which is greater than the speed at which the fan wheel 74 is moving the pocket away from the discharge station 88.

As the pocket continues to rotate and the signature moves downwardly into the pocket, a trailing end portion of the signature 40 is released from the tape conveyor 64 at the discharge station 88. The signature 40 then free falls downwardly into the pocket 92 under the combined influence of its momentum and gravity. As the signature 40 free falls into the pocket 92, the leading end portion 46 of the signature engages a closed inner end portion or bottom 112 of a pocket 92.

After a signature 40 has left the tape conveyor assembly 64 and been received in a pocket 92, rotation of the fan wheel 74 moves the signature around to a position opposite from the discharge station 88. The signature then falls out of the pocket 92 onto the delivery belt conveyor 108 (FIG. 1). The delivery belt conveyor 108 moves the signature 40 out of the folder assembly 10.

The tape conveyor 76, fan wheel 78 and a delivery belt conveyor 116 in the right delivery section 60 cooperate with each other in the same manner as previously described for the tape conveyor 64, fan wheel 74 and delivery belt conveyor 108 of the left delivery section 58. Thus, signatures 40 sequentially move from a discharge station 120 (FIG. 1) of the tape conveyor assembly 76 to pockets in a circular fan wheel 78. The signatures 40 are transferred from the fan wheel 78 to the delivery belt conveyor 116.

The general construction and mode of operation of the aforementioned components of the folder assembly 10 are known. Thus, tape conveyors have previously been used to convey signatures to fan wheels. The fan wheels have previously been used to convey signatures to delivery belt conveyors.

In the illustrated embodiment of the invention, it is preferred to use two tape conveyor assemblies 64 and 76 with two fan wheels 74 and 78. However, a greater or lesser number of conveyors could be used if desired. In addition, conveyors of a type which is different from the illustrated type of conveyors could be used if desired. For example, the second conveyor 74 could include a linear array of pockets. Of course, other known types of signature forming apparatus 16 could be used if desired.

Corregator Assembly

In accordance with a feature of the present invention, a corrugator assembly 126 (FIGS. 1, 2 and 3) is located at the discharge station 88. The corrugator assembly 126 stiffens the signatures 40 by forming a corrugation 132 (FIG. 4) in each of the signatures. The corrugation 132 extends from the leading end portion 46 of the signature 40 to the trailing end portion 48 of the signature.

The corrugation 132 stiffens the signature 40 and causes the signature to remain closed and inhibits deflecting during movement of the signature from the discharge station 88 to the fan wheel 74 (FIG. 1). In the absence of the corrugation 132, the signature 40 tends to deflect and/or tee leading end portion 46 of the signature tends to open as the signature moves from the discharge station 88 toward the fan wheel 74.

By forming a corrugation 132 in each of the signatures 40 in turn, the signatures are stiffened. This inhibits flexing of the material of the signature 40 so that the signature tends to remain closed and inhibits deflection as it moves from the discharge station 88 into a pocket 92 of the fan wheel 74. Since the corrugation 132 stiffens the signature 40 so that it tends to remain closed and inhibits deflection as it moves through the space between the discharge station 88 and the fan wheel 74, the signature 40 can be moved at a relatively high speed from the first or tape conveyor 64 to the second conveyor or fan wheel 74. Thus, in one specific folder assembly, the addition of the corrugation 132 enabled the speed of movement of the signatures to be increased from approximately 1,200 feet per minute to a speed of between 1,800 to 2,000 feet per minute.

The specific speed at which a particular corrugated signature 40 can be moved from the first conveyor 64 to the second conveyor 74 will vary with many factors. Thus, the speed at which the corrugated signature can move between conveyors will vary with the thickness and/or flexibility of the material of the signature. However, the speed at which a particular signature 40 can be moved between the conveyors is increased significantly by forming the corrugation 132 in the signature. Since there are many factors which affect the speed at which signatures can be fed from the tape conveyor 64 to the fan wheel 74, it should be understood that the present invention is not to be considered as being limited to any particular signature feed speed.

Although the corrugation 132 stiffens the signatures 40 so that they can be sequentially transferred from the tape conveyor 64 to the fan wheel 74 at a relatively high speed, the signatures should have flat major side surfaces 52 and 54 after the signatures have been delivered from the folder assembly 10. Therefore, the corrugation 132 is temporary and disappears after a signature 40 has moved into the fan wheel 74.

To enable the corrugation 132 to disappear, the corrugator assembly 126 resiliently deflects the signature 40 to form a corrugation without creasing or permanently deforming the signature. After the signature 40 has passed completely through the corrugator assembly 126, the natural resilience of the sheet material forming the signature causes the signature to return to its original configuration. Thus, the corrugation 132 will disappear after the signature has left the corrugator assembly 126.

The corrugation 132 remains in the signature 40 as long as the signature is engaged by the corrugator assembly 126. This is because the corrugator assembly 126 resiliently flexes the material of the signature 40 to establish and maintain the corrugation 132 in the signature.

The opening 100 (FIG. 2) to a fan wheel pocket 92 which is to receive a signature 40, is spaced from the corrugator assembly 126 by a distance which is substantially less than the distance between the leading and trailing end portions 46 and 48 of the signature. Therefore, when a signature 40 enters the pocket 92 in the fan wheel 74, the corrugator assembly 126 still engages the signature. This enables the corrugator assembly 126 to maintain the corrugation 132 and stiffen the signature 40 as the leading end portion 46 of the signature moves through the space between the tape conveyor 64 and fan wheel 74.

Controlled feeding of a signature 40 into a fan wheel pocket 92 may be enhanced by maintaining the corrugation 132 throughout the large majority of the time during which the signature is moving into the pocket. Thus, the corrugator assembly 126 is close to the circular path 104 of movement of the outer end or tips 136 (FIG. 2) of the fan elements 96. This enables a signature 40 to remain in engagement with the corrugator assembly 126 during a large majority of the time during which it is fed from the discharge station 88 into a pocket 92.

When the trailing end portion 48 of a signature 40 leaves the corrugator assembly 126, more than fifty percent of the length of the signature between the leading and trailing end portions 46 and 48 will be disposed in a pocket 92 of the fan wheel 74. This means that the corrugation 132 is maintained by the corrugator assembly 126 during the large majority of the feeding of a signature 40 into a pocket 92. Therefore, the signature 40 remains relatively stiff and easy to control.

When the trailing end portion 48 of a signature leaves the corrugator assembly 126, the force on the signature to establish the corrugation 132 is terminated. Therefore, at this time, the natural resilience of the material of the signature 40 starts to initiate elimination of the corrugation 132. Although some slight residual of the corrugation 132 may remain, by the time that the signature 40 has been deposited on the delivery belt conveyor 108 (FIG. 1), the corrugation will have substantially disappeared.

The corrugator assembly 126 projects between the tapes 82 (see FIG. 3) to form the corrugation 132. The corrugator assembly 126 may have any one of many known constructions. In the illustrated embodiment of the invention, the corrugator assembly 126 includes a corrugator roll 140. The corrugator roll 140 has a rigid steel base 142 with cylindrical tape backing sections 144. The metal base 142 also includes relatively small diameter cylindrical intermediate sections 146 which are disposed between and are coaxial with the tape backing sections 144. The corrugator roll 140 rotates about an axis which extends parallel to the axis of rotation of the fan wheel 74.

Figure 3:
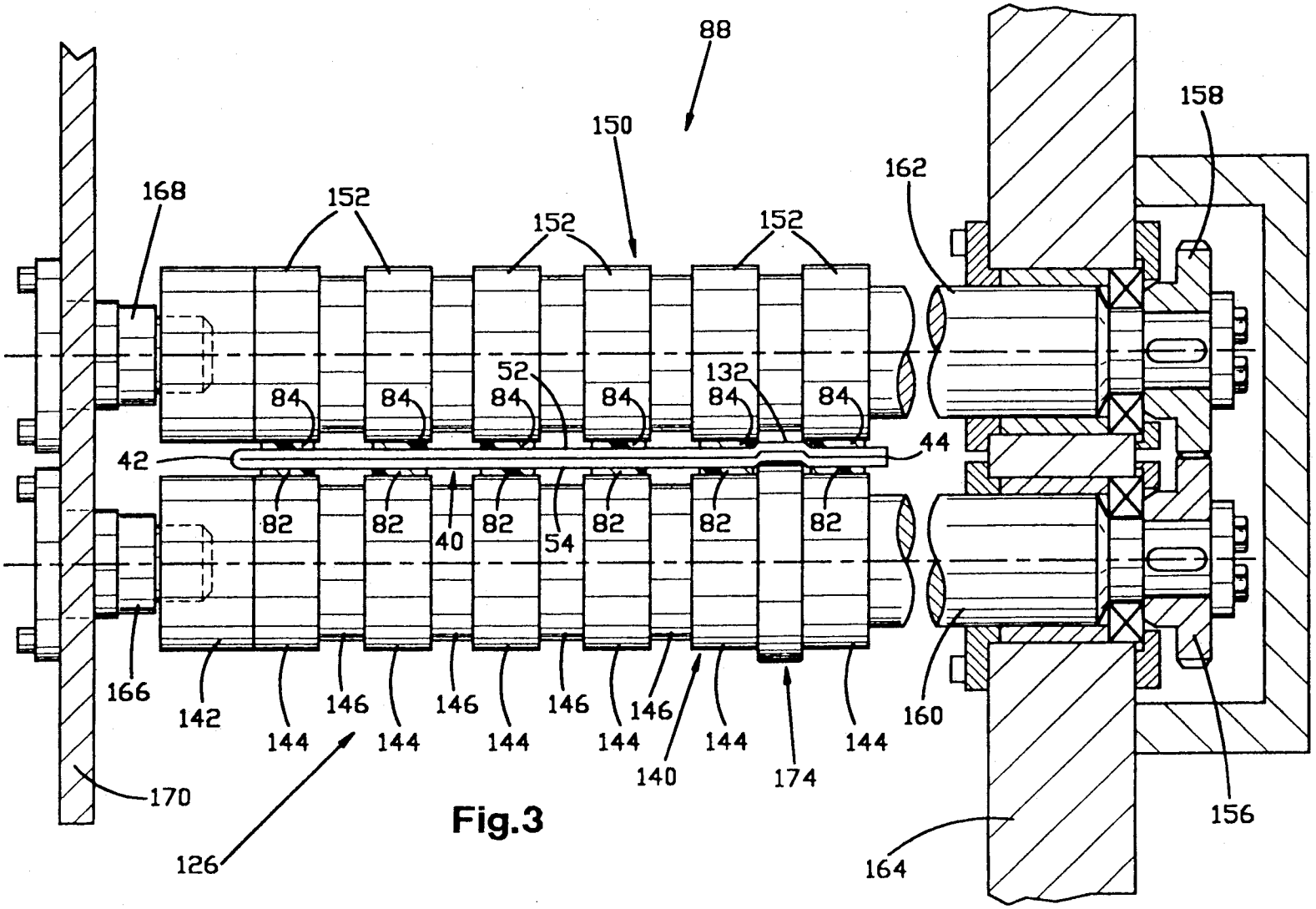
FIG. 3 is an enlarged, somewhat schematicized view, illustrating the manner in which a corrugation is formed in a signature by the corrugator assembly.

A cylindrical outer side surface of each of the tape backing sections 144 engages one side of a tape 82. The tape backing section 144 presses the opposite side of the tape 82 against a major side surface 54 of a signature 40 (FIG. 3). The surface speed of the tape backing section 144 and the speed of movement of the tape 82 is the same so that there is no slippage between the tape backing section 144 and the tapes 82.

The base roll 142 of the corrugator assembly 126 is driven in timed relationship with a tape backing roll 150 for the tapes 84. The metal tape backing roll 150 has cylindrical tape backing sections 152 which engage the tapes 84. It should be understood that although the corrugator roll 140 and tape backing roll 150 appear to be vertically aligned with each other in FIG. 3, they are actually vertically offset from each other in the manner shown in FIGS. 1 and 2. However, the rolls 140 and 150 may be vertically aligned, if desired.

The corrugator roll 140 and tape backing roll 150 are rotated in timed relationship with each other at the same surface speed by meshing gears 156 and 158 (FIG. 3). The gears 156 and 158 are secured to bearing support end portions 160 and 162 of the rolls 140 and 150. The bearing end support portions 160 and 162 are supported by an end wall 164 of the folder assembly 10. The opposite end portions of the shafts 140 and 150 are rotatably supported on stationary stub shafts 166 and 168 which are connected with a second side wall 170 of the folder assembly.

A cylindrical corrugation section 174 is disposed on the corrugator roll 140 and projects between the tapes 82 into engagement with the signature 40. The cylindrical corrugator section 174 has a larger diameter than and is disposed in a coaxial relationship with the backing and intermediate sections 144 and 146 of the corrugator roll 140. The cylindrical corrugator section 174 has a radius which is greater than the sum of the radius of the tape backing section 144 and the thickness of the tape 82. Therefore, the corrugator section 174 projects past the tapes 82 to resiliently deflect the signature 40 and form the corrugation 132 in the manner illustrated in FIG. 3.

In order to enable the corrugator section 174 to resiliently deflect the signature 40 to form the corrugation 132 without permanent deformation of the signature, the outside of the corrugator section 174 is formed of a flexible or forgiving material which does no crease the signature 40. However, the corrugator section 174 applies sufficient force against the signature 40 to resiliently deflect the signature and form the corrugation 132. Since the signature 40 is deflected as long as it is in engagement with the corrugator section 174, the corrugation 132 remains in the signature 40 until the signature moves out of engagement with the corrugator section.

The corrugator section 174 is disposed on a relatively small diameter section of the base roll 142. Thus, the corrugator section 174 is formed on a section of the base roll 142 having the same diameter and axial extent as an intermediate section 146 of the base roll 142.

The corrugator section 174 includes an annular polymeric body or support ring 180 (FIG. 5) which is secured to the base roll 142 for rotation therewith. The annular support ring 180 has a cylindrical outer side surface 182 with a radius which is approximately equal to the sum of the radius of a tape backing section 144 (FIG. 3).

A resiliently deflectable crown section 186 (FIG. 5) is secured to the support ring 180 and rotates with the support ring and corrugator roll 140. The crown section 186, once secured to surface 182 of support ring 180, has an outside radius which is greater than the sum of the radius of the tape backing section 144 and the thickness of the tape 82. Sufficient space is maintained between the tapes 82 to enable the corrugator section 174 to project past the tapes and form the corrugation 132.

The crown section 186 sequentially engages with signatures 40 to form the corrugations 132. The cylindrical crown section 186 is disposed in a coaxial relationship with the support ring 180. The crown section 186 is radially yieldable to enable a signature 40 to be resiliently deflected to form the corrugation 132 without permanent deformation of the signature.

The yieldable crown section 186 includes a cylindrical inner layer 190 which circumscribes and is coaxial with the support ring 180. The cylindrical inner layer 190 is formed of cloth or fabric. The inner layer 190 is fixedly secured to the support ring 180 by a cylindrical layer 192 of adhesive.

A cylindrical outer layer 196 (FIG. 5) is coaxial with and circumscribes the cylindrical inner layer 190. The cylindrical outer layer 196 is formed of a cloth or fabric which is, to some extent at least, radially yieldable. The outer layer 196 is releasably connected with the inner layer 190 by a hook and loop type fastener 198 which is disposed between the inner and outer layers 190 and 196. The hook and loop type fastener 198 is releasable to enable the outer layer 196 to be disconnected from the inner layer 190 and replaced when the outer layer becomes worn by engagement with signatures 40.

The hook and loop type fastener 198 includes a plurality of hooks 202 which are fixedly connected to and extend radially outwardly from the inner layer 190. The fastener 198 also includes a plurality of loops 204 which are fixedly connected to and extend radially inwardly from the outer layer 196. The hooks 202 releasably engage the loops 204 to interconnect the inner and outer layers. The hooks and loops 202 and 204 are formed of a synthetic material which causes them to adhere when they are pressed together.

Although the hooks 202 have been shown as projecting outwardly from the inner layer 190 and the loops 204 as projecting inwardly from the outer layer, their positions could be reversed. Thus, the hooks could project inwardly from the outer layer and the loops could project outwardly from the inner layer if desired. The hook and loop type fastener 198 is of a well known construction and is commercially available under the trademark "VELCRO". The hook and loop type fastener 198 can, to some extent at least, be compressed to allow the outer layer 196 to yield or move toward the inner layer 190 under the influence of forces transmitted to the outer layer 196 during the formation of the corrugation 132.

Figure 5:
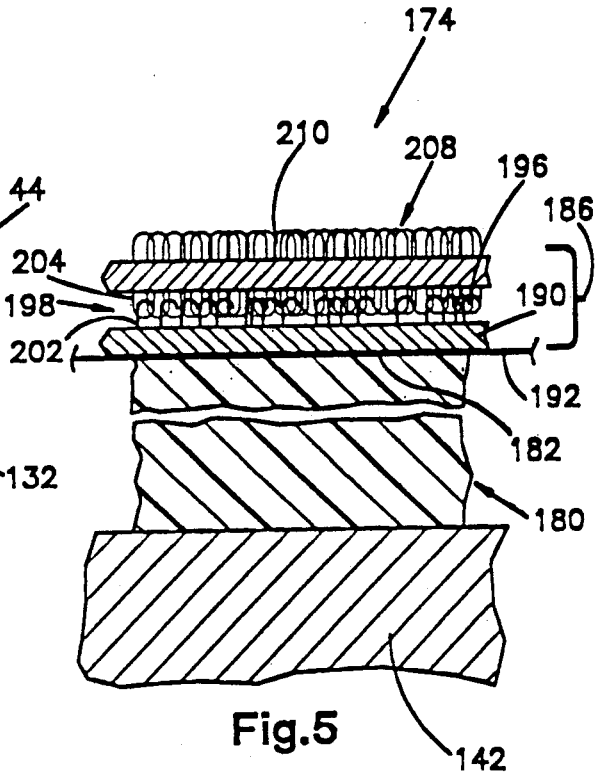
FIG. 5 is an enlarged schematic fragmentary sectional view depicting the construction of a corrugating section of the corrugator assembly of FIG. 3.

The crown section 186 has a signature engaging cylindrical outer side 208 (FIG. 5). The signature engaging outer side 208 is flexible to prevent permanent deformation of a signature during the formation of a corrugation 132. In the illustrated embodiment of the invention, the cylindrical outer side 208 is formed by resiliently deflectable loops 210 which project radially outwardly from the outer layer 196. The loops 210 are of the same construction as the loops 204 of the fastener 198.

The cylindrical outer side 208 of the crown section 186 yields minimum marking to the signature 40. However, although the resilient outer side 208 having the construction described herein is preferred, other types of crown sections could be used, if desired. For example, the corrugator section 174 could be a chrome plate wheel, a circular brush, a circular plastic wheel, etc., if desired.

The outer side 208 of the crown section 186 (FIG. 5) moves at a higher surface speed than the signature 40. Therefore, there is slippage or sliding engagement between the outer side 208 and the major side surface 54 (FIGS. 3 and 4) of a signature as the corrugation 132 is formed. This slippage results in a yieldable brushing type engagement between the crown 186 (FIG. 5) on the corrugation section 174 and a signature 40 to resiliently deflect the signature without permanently deforming the signature. If desired, the outer side 208 of the crown section 186 could move at the same speed as the signature 40.

The construction of the crown section 186 of the corrugator section 174 enables the outer layer 196 to be readily disconnected from the inner layer 190 when the outer layer becomes worn. Thus, the hook and loop type fastener 198 can be readily released to enable a worn outer layer 196 to be removed from the inner layer 190. A new outer layer can then be readily connected with the inner layer 190 by the hook and loop type fastener 198.

The crown section 186 could be formed with a different construction if desired. It is also contemplated that the corrugator assembly 126 could have other known constructions. For example, the corrugator assembly could have a stationary member which engages the signatures to resiliently deflect the signatures.

Corregator Assembly—Second Embodiment

Figure 6:
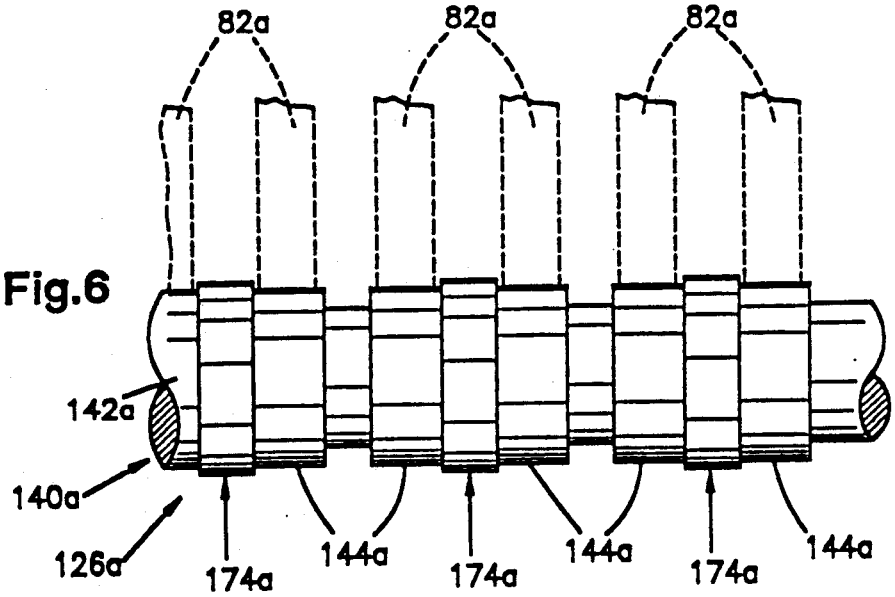
FIG. 6 is a fragmentary schematic illustration of a corrugation roll in an embodiment of the invention which forms a plurality of corrugations in a signature.

In the embodiment of the corrugator assembly 126 illustrated in FIG. 3, a single corrugator section 174 forms a single corrugation 132 in a signature 40. However, it is contemplated that it may be desirable to form a plurality of corrugations in each signature in order to further stiffen the signature. In the embodiment of the invention illustrated in FIG. 6, a plurality of corrugator sections are provided to form a plurality of corrugations in each signature. Since the embodiment of the invention illustrated in FIG. 6 is generally similar to the embodiment of the invention illustrated in FIGS. 1–5, similar numerals will be utilized to designate similar components, the suffix letter "a" being associated with the elements of FIG. 6 to avoid confusion.

A corrugator assembly **126*a* includes a corrugator roll 140*a* having a plurality of corrugator sections 174*a*. The cylindrical corrugator sections 174*a* project radially outwardly from cylindrical tape backing sections 144*a* by a distance which is greater than the sum of the radius of a cylindrical tape backing section 144*a* and the thickness of a tape 82*a*. Therefore, the corrugator sections 174*a* project between the spaced apart tapes 82*a* and are effective to form a plurality of spaced apart corrugations which extend between leading and trailing end portions of a signature at spaced apart locations on the signature. Although three corrugator sections 174*a* have been shown in FIG. 6**, a greater or lesser number of corrugator sections could be used if desired.

Each of the corrugator sections **174*a* has the same construction as the corrugator section 174. Thus, each corrugator section 174*a* has a polymeric support ring which is secured to a metal base roll 142*a*. A resilient crown, corresponding to the crown 186 of FIG. 5, is connected with each of the support rings. Each of the crowns includes inner and outer layers which are releasably interconnected by hook and loop type fasteners. The crowns have outer sides formed by loops, similar to the loops 210 of FIG. 5**.

Conclusion

The present invention provides a new and improved signature handling apparatus 14 in which a first conveyor 64 has a discharge station 88 at which signatures 40 are transferred to a second conveyor 74. In order to increase the speed at which the signatures 40 can move between conveyors 64 and 74, one or more corrugations 132 are formed in the signatures 40 to stiffen the signatures. Thus, a corrugator assembly 126 is located at the discharge station 88 of the first conveyor 64 and sequentially forms corrugations 132 extending between leading and trailing end portions 46 and 48 of the signatures 40 to stiffen the signatures.

Since it is desired to have the signatures 40 free of corrugations 132 after the transfer has been made from the first conveyor 64 to the second conveyor 74, the corrugator assembly 126 resiliently deforms the signatures to form temporary corrugations which disappear after the signatures have moved out of the corrugator assembly. To have the corrugations 132 maintained in the signatures 40 during their high speed movement between conveyors 64 and 74, the corrugator assembly is spaced from the second conveyor assembly 74 by a distance which is less than the distance between leading and trailing end portions 46 and 48 of the signatures. Therefore, during movement of a leading portion of a signature 40 through the space between the two conveyors 64 and 74 and during initial engagement of the signature with the second conveyor, a trailing portion of the signature is disposed in the corrugator assembly 126.

The foregoing description of preferred embodiments of the invention have related to one known type of corrugator assembly 126 in which a rotatable corrugator roll 140 or **140*a*** has been used to form one or more corrugations in a signature. However, other types of corrugator assemblies which do not permanently mark or deform a signature could be used if desired. Thus, it is contemplated that the corrugations could be formed by one or more stationary guides which press against the signatures. Another way of forming the corrugations would be to use air blasts. If desired, offset tapes on opposite sides of the signatures could be used to form the corrugations. Therefore, the claim language setting forth the invention is not to be construed as being limited to any particular type of corrugator assembly except where required by the specific wording of a claim.

Having described specific preferred embodiments of the invention, the following is claimed:

1. A signature handling apparatus comprising first conveyor means for sequentially conveying signatures, second conveyor means for conveying signatures received from said first conveyor means, said first conveyor means having a discharge portion through which signatures sequentially move from said first conveyor means to said second conveyor means, said first conveyor means including a first plurality of tapes engaging a first plurality of rolls with a longitudinal run of said first plurality of tapes extending between a first roll of the first plurality of rolls at a location spaced from the discharge portion of said first conveyor means and a second roll of the first plurality of rolls at the discharge portion of said first conveyor means, said first conveyor means further including a second plurality of tapes engaging a second plurality of rolls with a first roll of the second plurality of rolls disposed at the discharge portion of said first conveyor means adjacent to the longitudinal run of said first plurality of tapes at a location disposed between and spaced along said first plurality of tapes from said first and second rolls of said first plurality of rolls, and corrugator means located at the discharge portion of said first conveyor means for forming corrugations extending between leading and trailing end portions of the signatures, said corrugator means being mounted for rotation with said first roll of said second plurality of rolls and being engagable with each of the signatures in turn at a location spaced along said first plurality of tapes from said first and second rolls of said first plurality of rolls to form a corrugation in each of the signatures in turn while a side of the signature opposite from said corrugator means is in engagement with the longitudinal run of the first plurality of tapes by pressing a portion of each signature in turn into space disposed between tapes of the first plurality of tapes at a location spaced from the first and second rolls of the first plurality of rolls, said corrugator means being spaced from said second conveyor means by a distance which is less than the distance between the leading and trailing end portions of the signatures to enable the leading end portion of each one of the signatures in turn to move to said second conveyor means while the one signature is engaged by said corrugator means.

2. An apparatus as set forth in claim 1 wherein said second conveyor means includes a plurality of pockets which are sequentially moved past the discharge portion of said first conveyor means, each of said pockets including surface means for engaging a side surface of a signature while the signature is engaged by said corrugator means.

3. An apparatus as set forth in claim 2 wherein said second conveyor means includes means for moving said pockets along a continuous circular path at least a portion of which is spaced from said corrugator means by a distance which is less than the distance between the leading and trailing end portions of the signatures.

4. An apparatus as set forth in claim 1 wherein said corrugator means includes a corrugator roll having a first portion with a first diameter and a second portion with a second diameter which is greater than said first diameter, said second portion of said roll including resiliently yieldable surface means for resiliently deflecting each of the signatures in turn to form a corrugation in each of the signatures in turn.

5. A signature handling apparatus as set forth in claim 1 wherein a plurality of longitudinally extending spaces are disposed between adjacent tapes of said first plurality of tapes, said corrugator means including a cylindrical corrugation section which is aligned with one of the longitudinally extending spaces between adjacent tapes of said first plurality of tapes, said cylindrical corrugation section having a cylindrical outer side surface which engages each of the signatures in turn at a location aligned with said one longitudinally extending space between adjacent tapes of said first plurality of tapes.

6. A signature handling apparatus comprising a roll, a cylindrical inner layer extending around said roll, means for connecting said inner layer to said roll, a radially yieldable cylindrical outer layer extending around said inner layer and engagable with a major side surface of each signature of a plurality of signatures, and a cylindrical layer of hook and loop fastener means extending around said cylindrical inner layer for releasably interconnecting said inner and outer layers and for yieldably supporting said cylindrical outer layer, said cylindrical layer of hook and loop fastener means being disposed in a coaxial relationship with and being disposed between said inner and outer layers, said hook and loop fastener means including a plurality of loops which are disposed in a cylindrical array between said inner and outer layers and which are connected with a first one of said inner and outer layers and a plurality of hooks which are disposed in cylindrical array between said inner and outer layers and which are connected with a second one of said inner and outer layers, said plurality of hooks being engagable with said plurality of loops to releasably interconnect said inner and outer layers.

7. An apparatus as set forth in claim 6 wherein said roll includes a metal base having a cylindrical outer side surface and an annular body of polymeric material circumscribing said cylindrical outer side surface of said base, said first layer of material being fixedly secured to said annular body.

8. A signature handling apparatus for use in handling signatures having a folded edge portion disposed opposite from an open edge portion, said apparatus comprising first conveyor means for sequentially conveying signatures with leading and trailing end portions of the signatures extending between the folded and open edge portions of the signatures, second conveyor means for conveying signatures received from said first conveyor means, said first conveyor means having a discharge portion through which signatures sequentially move from said first conveyor means to said second conveyor means, and corrugator means located at the discharge portion of said first conveyor means for forming corrugations adjacent to the open edge portions of the signatures and extending between leading and trailing end portions of the signatures in a parallel relationship with the folded edge portions of the signatures, said corrugator means being spaced from said second conveyor means by a distance which is less than the distance between the leading and trailing end portions of the signatures to enable the leading end portion of each one of the signatures in turn to move to said second conveyor means while the one signature is engaged by said corrugator means and to enable any tendency for the leading end portion of the one signature to deflect as the leading end portion of the one signature moves from said first conveyor means to said second conveyor means to be resisted by the corrugation formed in the one signature, said corrugator means including a base, a layer of material having a cylindrical outer side for engaging each of the signatures in turn, and resiliently yieldable fastener means disposed radially inwardly of said outer side for releasably connecting said layer of material with said base and for yieldably supporting said layer of material to enable said layer of material to resiliently deflect each of the signatures in turn to form corrugations without permanent deformation of the signatures.

9. A signature handling apparatus as set forth in claim 8 wherein said fastener means includes a plurality of loops and a plurality of hooks which are engagable with the plurality of loops to releasably connect the layer of material with the base.

10. A signature handling apparatus as set forth in claim 9 wherein said cylindrical outer side of said layer of material is formed by a second plurality of loops having the same construction as the plurality of loops which are engagable with the plurality of hooks.

11. A signature handling apparatus for use in handling signatures having a folded edge portion disposed opposite form an open edge portion, said apparatus comprising first conveyor means for sequentially conveying signatures with leading and trailing end portions of the signatures extending between the folded and open edge portions of the signatures, said first conveyor means being operable to sequentially convey the signatures along a path with the folded and open edge portions of the signatures extending parallel to a longitudinal axis of the path and with leading and trailing end portions of the signatures extending transversely to the longitudinal axis of the path, second conveyor means for conveying signatures received from said first conveyor means, said first conveyor means having a discharge portion through which signatures sequentially move from said first conveyor means to said second conveyor means, and corrugator means located at the discharge portion of said first conveyor means for forming corrugations adjacent to the open edge portions of the signatures and extending between the leading and trailing end portions of the signatures in a parallel relationship with the folded edge portions of the signatures without permanent deformation of the signatures, said corrugator means being spaced from said second conveyor means by a distance which is less than the distance between leading and trailing end portions of the signatures, said second conveyor means including first surface means for engaging the leading end portions of the signatures while the signatures are engaged by said corrugator means to enable any tendency for the leading end portion of a signature to deflect as the leading end portion of a signature moves from said first conveyor means to said second conveyor means to be resisted by the portion of a corrugation formed in the signature, said corrugator means including a roll, a cylindrical inner layer extending around said roll, means for connecting said inner layer to said roll, a cylindrical outer layer extending around said inner layer and engagable with a major side surface of each of the signatures in turn and remaining in engagement with the major side surface of each of the signatures in turn until after a leading end portion of the signature has moved into engagement with said first surface means, and a cylindrical layer of hook and loop fastener means extending around said cylindrical inner layer for releasably interconnecting said inner and outer layers and for yieldably supporting said cylindrical outer layer to enable said cylindrical outer layer to resiliently deflect each signature in turn without permanent deformation of the signatures, said cylindrical layer of hook and loop fastener means being disposed in a coaxial relationship with and being disposed between said inner and outer layers, said hook and loop fastener means including a plurality of loops which are disposed in a cylindrical array between said inner and outer layers, said hook and loop fastener means further including a plurality of hooks disposed radially in a cylindrical array between said inner and outer layers.

12. An apparatus as set forth in claim 11 wherein said outer layer includes surface means for sequentially engaging a major side surface of each signature of the plurality of signatures, said surface means including a plurality of loops having the same construction as the plurality of loops of said hook and loop fastener means, said plurality of loops of said surface means being disposed in a cylindrical array around the outside of said layer.

13. A signature handling apparatus comprising first conveyor means for sequentially conveying signatures, second conveyor means for conveying signatures received from said first conveyor means, said first conveyor means having a discharge portion through which signatures sequentially move from said first conveyor means to said second conveyor means, said first conveyor means including a first plurality of tapes engaging a first plurality of rolls with a longitudinal run of said first plurality of tapes extending between a first roll of the first plurality of rolls at a location spaced from the discharge portion of said first conveyor means and a second roll of the first plurality of rolls at the discharge portion of said first conveyor means, said first conveyor means further including a second plurality of tapes engaging a second plurality of rolls with a first roll of the second plurality of rolls disposed at the discharge portion of said first conveyor means adjacent to the longitudinal run of said first plurality of tapes at a location disposed between and spaced along said first plurality of tapes from said first and second rolls of said first plurality of rolls, and corrugator means located at the discharge portion of said first conveyor means for forming corrugations extending between leading and trailing end portions of the signatures, said corrugator means being mounted for rotation with said first roll of said second plurality of rolls and being engageable with each of the signatures in turn at a location spaced along said first plurality of tapes from said first and second rolls of said first plurality of rolls to form a corrugation in each of the signatures in turn while a side of the signature opposite from said corrugator means is in engagement with the longitudinal run of the first plurality of tapes by pressing a portion of each signature in turn into space disposed between tapes of the first plurality of tapes at a location spaced from the first and second rolls of the first plurality of rolls, said corrugator means being spaced from said second conveyor means by a distance which is less than the distance between the leading and trailing end portions of the signatures to enable the leading end portion of each one of the signatures in turn to move to said second conveyor means while the one signature is engaged by said corrugator means, said corrugator means includes a circular base, a circular layer of material circumscribing said circular base and having a circular outer side for engaging each of the signatures in turn, and a circular layer of hook and loop fastener means circumscribing said circular base for releasably connecting said circular layer of material with said base, said circular layer of hook and loop fastener means being coextensive with a radially inner side of said circular layer of material and including a plurality of loops and a plurality of hooks which are engageable with the plurality of loops to releasably connect the layer of material with said base.

14. An apparatus as set forth in claim 13 wherein said circular outer side of said circular layer of material is formed by a second plurality of loops having the same construction as the plurality of loops which are engagable with the plurality of hooks.

15. A signature handling apparatus as set forth in claim 13 wherein a plurality of longitudinally extending spaces are disposed between adjacent tapes of said first plurality of tapes, said corrugator means including a cylindrical corrugation section which is aligned with one of the longitudinally extending spaces between adjacent tapes of said first plurality of tapes, said cylindrical corrugation section having a cylindrical outer side surface which engages each of the signatures in turn at a location aligned with said one longitudinally extending space between tapes of said first plurality of tapes to press a portion of each of the signatures in turn into said one longitudinally extending space between adjacent tapes of said first plurality of tapes.

16. An apparatus as set forth in claim 13 wherein said second conveyor means includes a plurality of pockets which are sequentially moved past the discharge portion of said first conveyor means, each of said pockets including surface means for engaging a side surface of a signature while the signature is engaged by said corrugator means.

17. An apparatus as set forth in claim 16 wherein said second conveyor means includes means for moving said pockets along a continuous circular path at least a portion of which is spaced from said corrugator means by a distance which is less than the distance between the leading and trailing end portions of the signatures.

18. A signature handling apparatus comprising a roll, a cylindrical inner layer extending around said roll, means for connecting said inner layer to said roll, a radially yieldable cylindrical outer layer extending around said inner layer and engageable with a major side surface of each signature of a plurality of signatures, and a cylindrical layer of hook and loop fastener means extending around said cylindrical inner layer for releasably interconnecting said inner and outer layers and for yieldably supporting said cylindrical outer layer, said cylindrical layer of hook and loop fastener means being disposed in a coaxial relationship with and being disposed between said inner and outer layers, said hook and loop fastener means including a plurality of loops which are disposed in a cylindrical array between said inner and outer layers and which are connected with a first one of said inner and outer layers and a plurality of hooks which are disposed in cylindrical array between said inner and outer layers and which are connected with a second one of said inner and outer layers, said plurality of hooks being engageable with said plurality of loops to releasably interconnect said inner and outer layers, said outer layer including surface means for sequentially engaging a major side surface of each signature of the plurality of signatures, said surface means including a plurality of loops having the same construction as the plurality of loops of said hook and loop fastener means, said plurality of loops of said surface means being disposed in a cylindrical array around the outside of said outer layer.

19. A signature handling apparatus comprising a roll, a cylindrical inner layer extending around said roll, means for connecting said inner layer to said roll, a radially yieldable cylindrical outer layer extending around said inner layer and engageable with a major side surface of each signature of a plurality of signatures, and a cylindrical layer of hook and loop fastener means extending around said cylindrical inner layer for releasably interconnecting said inner and outer layers and for yieldably supporting said cylindrical outer layer, said cylindrical layer of hook and loop fastener means being disposed in a coaxial relationship with and being disposed between said inner and outer layers, said hook and loop fastener means including a plurality of loops which are disposed in a cylindrical array between said inner and outer layers and which are connected with a first one of said inner and outer layers and a plurality of hooks which are disposed in cylindrical array between said inner and outer layers and which are connected with a second one of said inner and outer layers, said plurality of hooks being engageable with said plurality of loops to releasably interconnect said inner and outer layers, said apparatus further including first conveyor means for sequentially conveying signatures, second conveyor means for conveying signatures received from said first conveyor means, said first conveyor means having a discharge portion through which signatures sequentially move from said first conveyor means to said second conveyor means, said roll being located at the discharge portion of said first conveyor means, said surface means being sequentially engageable with side surfaces of the signatures to form corrugations extending between leading and trailing end portions of the signatures, said roll being spaced from said second conveyor means by a distance which is less than the distance between the leading and trailing end portions of the signatures to enable the leading end portion of each one of the signatures in turn to move to said second conveyor means while the one signature is engaged by said surface means.

20. A signature handling apparatus comprising first conveyor means for sequentially conveying signatures, second conveyor means for conveying signatures received from said first conveyor means, said first conveyor means having a discharge portion through which signatures sequentially move from said first conveyor means to said second conveyor means, and corrugator means located at the discharge portion of said first conveyor means for forming corrugations extending between leading and trailing end portions of the signatures, said corrugator means being spaced from said second conveyor means by a distance which is less than the distance between the leading and trailing end portions of the signatures to enable the leading end portion of each one of the signatures in turn to move to said second conveyor means while the one signature is engaged by said corrugator means, said corrugator means including a circular base, a circular layer of material circumscribing said circular base and having a circular outer side for engaging each of the signatures in turn, and a circular layer of hook and loop fastener means circumscribing said circular base for releasably connecting said circular layer of material with said base, said circular layer of hook and loop fastener means including a circular array of loops extending around said base and a circular array of hooks extending around said base, said circular array of hooks being engageable with the circular array of loops to releasably connect the layer of material with said base.

21. An apparatus as set forth in claim 20 wherein said circular outer side of said circular layer of material is formed by a second circular array of loops.

* * * * *